United States Patent [19]

Johnson et al.

[11] Patent Number: 5,050,364

[45] Date of Patent: Sep. 24, 1991

[54] TWO-PART ANCHOR BOLT HOLDER

[75] Inventors: Michael S. Johnson, Everett; James I. Mothersbaugh, Bothell, both of Wash.

[73] Assignees: Anchor Bolt, Inc., Kirkland, Wash.; Aztec Concrete and Accessories, Inc., Infortuna, Calif.

[21] Appl. No.: 496,988

[22] Filed: Mar. 21, 1990

[51] Int. Cl.[5] ..... E04C 5/12

[52] U.S. Cl. ..... 52/705; 52/295

[58] Field of Search ..... 52/677-689, 52/698, 705, 699, 295, 704; 249/205, 207

[56] References Cited

U.S. PATENT DOCUMENTS

| | | | |
|---|---|---|---|
| 1,108,859 | 8/1914 | Bennett | 52/705 |
| 1,726,286 | 8/1929 | Bennet | 52/699 |
| 2,409,342 | 10/1946 | Cassidy | 52/684 |
| 2,760,272 | 8/1956 | Van Cantie | 33/180 |
| 3,150,429 | 9/1964 | Shaffer | 25/118 |
| 3,458,184 | 7/1969 | Schlosser | 269/287 |
| 3,500,607 | 3/1970 | Wilson | 52/699 |
| 3,552,734 | 1/1971 | Severino et al. | 269/287 |
| 3,912,218 | 10/1975 | Lister | 249/207 |
| 3,960,356 | 6/1976 | Adams | 249/205 |
| 3,963,210 | 6/1976 | Macklin | 249/210 |
| 4,261,544 | 4/1981 | Addison | 249/207 |
| 4,375,143 | 3/1983 | Godlewski | 52/98 |
| 4,380,329 | 4/1983 | Nunno | 269/41 |
| 4,412,407 | 11/1983 | Melfi et al. | 52/669 |
| 4,641,478 | 2/1987 | Nelson | 52/700 |
| 4,736,554 | 4/1988 | Tyler | 52/105 |

FOREIGN PATENT DOCUMENTS

| | | | |
|---|---|---|---|
| 213644 | 6/1967 | Sweden | 52/687 |
| 905635 | 9/1962 | United Kingdom . | |

OTHER PUBLICATIONS

A Photocopy of a Page from a Concrete Accessory Catalog entitled, "Aztec Concrete Accessories", p. 49, 3 Photographs in Series showing a Bolt Anchoring System.

*Primary Examiner*—James L. Ridgill, Jr.
*Attorney, Agent, or Firm*—Bruce A. Kaser

[57] ABSTRACT

The invention disclosed here is an anchor bolt holder that is designed to be used in setting an anchor belt in a concrete slab. The holder is a two-part system having a base, and a sleeve connectable to a socket in the base. The sleeve is adapted to receive and hold an anchor bolt's shank. Prior to pouring the slab, the base is first mounted to the decking or forming surface that underlies the slab. After certain other pre-pour items have been installed over the decking, the sleeve is then plugged into the base's socket and supports the anchor bolt vertically. The combined function of the sleeve and base is to fix the bolt in position during both the pour and cure phases of the slab, so that the bolt is held vertically with its threads projecting above the slab's top surface. The sleeve has openings through its sidewall that are sufficiently large to allow wet concrete the bolt's shank within the sleeve. Also, the sleeve is adapted to provide vertical adjustability of the anchor bolt's height relative to the decking, thus providing a way to accommodate bolt height to variations in slab depth.

17 Claims, 5 Drawing Sheets

Fig. 3
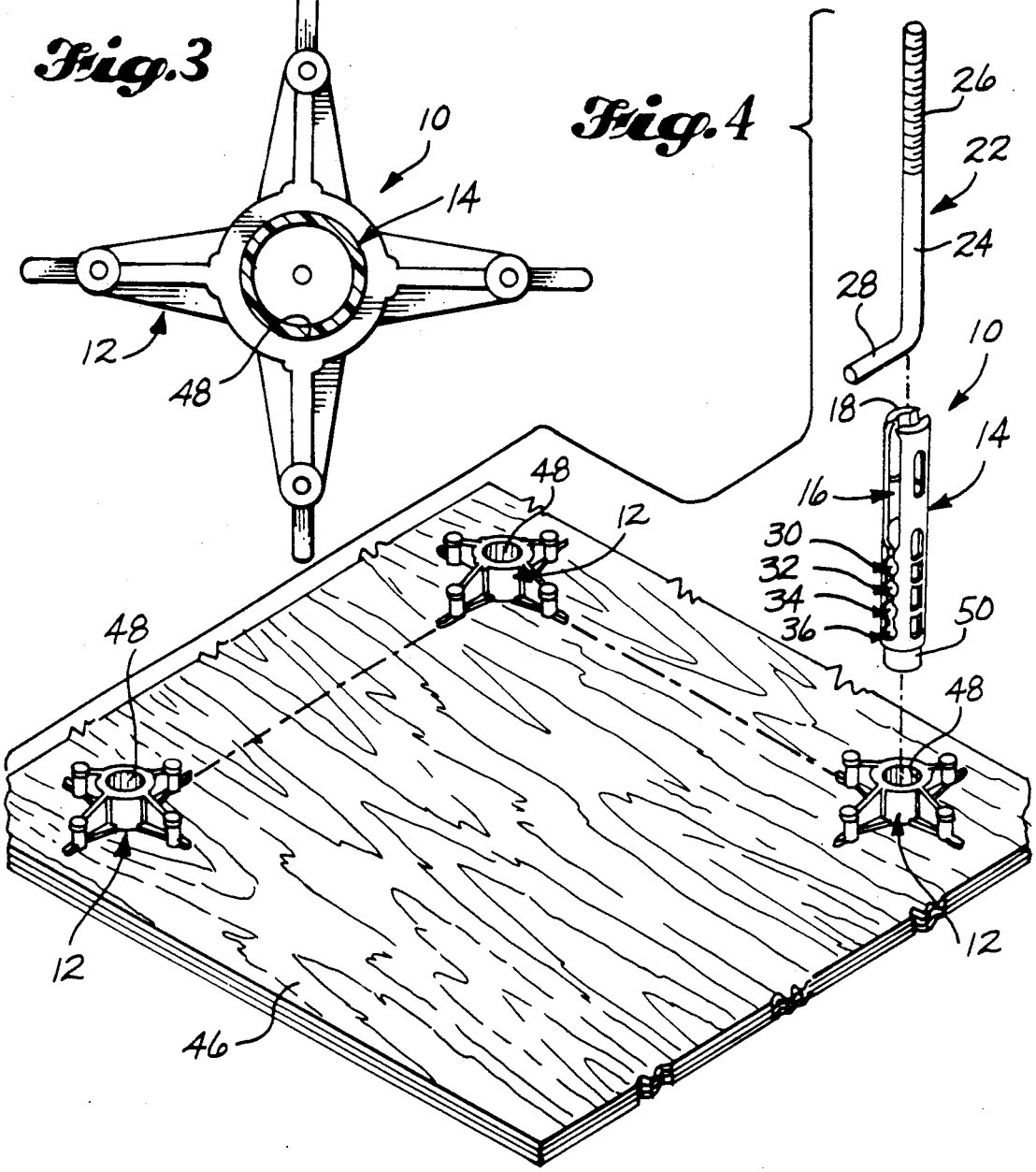
Fig. 4
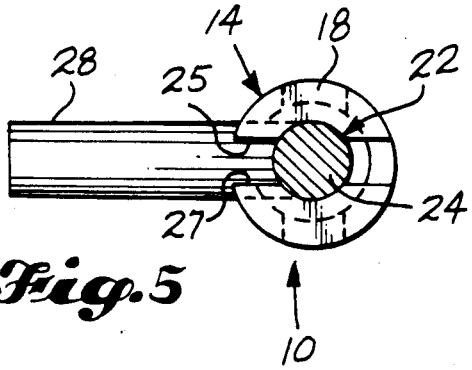
Fig. 5
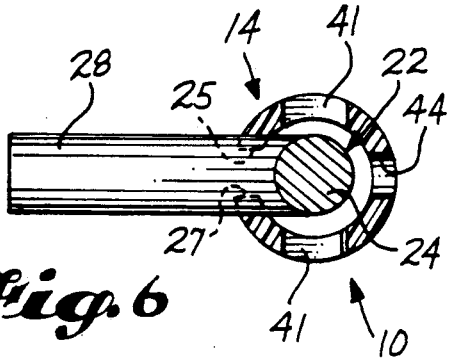
Fig. 6

18
10
40
25
27
40
26
55
16
14
52
41
22
30
32
41
24
34
38
39
36
20
28
50
53
48
12

TWO-PART ANCHOR BOLT HOLDER

TECHNICAL FIELD

This invention generally relates to anchor bolts that are used for securing certain structures to concrete, and more particularly, to devices for setting anchor bolts in specified positions in concrete during pouring and curing of the same.

BACKGROUND ART

An anchor bolt is a metal rod that is set or embedded in concrete, and has a threaded end that projects outwardly from the concrete's exterior surface. A nut threaded onto the end provides a way of bolting other structural members to such surface. The invention disclosed here has been developed for the purpose of solving certain unique problems associated with setting surface anchor bolts.

Modern-day construction often involves pouring large concrete slabs. By way of example, it is not unusual to pour slabs that cover areas as large as 7,000 square feet, or larger, at depths of 12 inches or more. It is also common for such slabs to be elevated from the ground during pouring since they are often used to construct the different levels of multiple-floor buildings. The methods for delivering, spreading and leveling the concrete for such pours are well-known, and need not be described here. However, obtaining properly set surface anchor bolts in the resultant slab or slabs has proven problematical.

Unlike concrete retainer walls and footings, where the concrete is poured between relatively closely-spaced vertical forming surfaces, placing and holding an anchor bolt in position during the pouring of concrete slabs is difficult, because of the unavailability of suitable places to mount overhead bolt-holding supports By way of comparison, in the case of a retainer wall, it is easy to place an overhead support across the top of its side forms. An equivalent device cannot be used over concrete slabs, however, because the concrete usually spans many feet from side to side, perhaps as far as 100 feet or more.

For this reason, it was common practice in the past to set anchor bolts after both pouring and curing the slab. This was done by boring individual openings in the concrete's hardened top surface, and subsequently installing anchor bolts in each opening. Each bolt was set or fixed in place by a coalescent filler that hardened after installation, the filler typically being wet concrete or mortar.

As a practical matter, current building code requirements have made this method obsolete Consequently, builders have taken to mounting anchor bolts to the decking or forming surface underlying the slab prior to pouring. Typically, such surface is made of ¾-inch plywood, although metal forms are also used, as well as other materials.

One method of mounting bolts to such forming surface involves using individual metal bolt-holding strips made of sheet metal. A small length at one end of such strip is bent 90° relative to its remaining length, and is nailed, stapled or glued to the forming surface in a manner so that the strip extends vertically upwardly. An anchor bolt is suitably attached to the strip, sometimes by baling wire, for example, and the strip holds it in place during pouring and curing of the slab.

The problem with this type of arrangement is that it interferes with the installation of other pre-pour items. For example, post-tensioning cables, electrical conduit, plumbing, and rebar or other concrete reinforcement are all typically installed over the forming surface prior to any given pour. Installing the anchor bolts first, in the manner just described, creates a situation where both the strips and bolts get knocked around and out of place as a result of installing the other pre-pour items The end result has been poor anchor bolt placement where individual bolts have either lost their vertical alignment after the pour, or their height is incorrect relative to the concrete's top surface. Furthermore, this problem cannot be solved by installing the bolt-holding strips after the other pre-pour items, because the other items generally take up most of the space over the forming surface, making it physically impossible to have working space for attaching the holding strips.

A known improvement over the system just described involves a two-part system where an extension rod, or dog, is welded to the anchor bolt and plugged into a separate base plate that is first attached to the forming surface. The base plate takes up little space prior to and does not interfere with other prepour preparations. After such preparations are made, the dog is thereafter simply plugged into an upwardly-opening socket in the base plate, thus fixing the bolt in position for the pour.

Unlike the present invention, this last system is unwieldy because it does not provide an easy way to adjust the bolt's vertical height relative to the forming surface. Obviously, slab depth can be a variable from one slab to another. The system just described requires on-site cutting and welding of the extension dog to an appropriate length, in order to correctly set the bolt's height relative to any given slab. The labor required for doing this can represent a fairly significant cost detriment to the builder.

U.S. Pat. Nos. 1,108,859; 1,726,286; and 4,412,407 all disclose systems for holding anchor bolts. The '859 patent discloses a type of system that is significantly different from the invention disclosed here because it is not directed to holding an anchor bolt in concrete both during and after the pour. Instead, the '859 system sets a threaded anchor, minus any bolt, in place during the pour, and provides an opening through the resultant slab for extending a bolt into threaded engagement with the anchor.

The '286 patent discloses another type of metal bolt-holding strip that functions somewhat similarly to the boltholding strip system described above, although it has other unique drawbacks that need not be mentioned here. The '407 patent discloses a one-part anchoring system that is essentially an insert for anchoring the lower end of an externally screw-threaded bolt. Similar to the '859 patent mentioned above, the '407 insert is not intended to be used for permanently setting an anchor bolt during pouring and curing of the slab. Instead, the bolt is subsequently installed or threaded into the insert afterward.

The invention disclosed and claimed here is significantly different from the devices and systems described above. It is perhaps closest in similarity to the two-part "welded-dog" system, and offers the same advantages as such system. However, it goes further in that it provides adjustability in bolt height, and is also generally cheaper to implement These differences including their advantages, will become better understood upon consideration of the following.

SUMMARY OF THE INVENTION

The invention is a two-part anchor bolt holder that is particularly well suited for setting "J" or "L"-shaped anchor bolts. Such anchor bolts typically have an elongated shank with a threaded end, and an opposite end that extends laterally relative to the shank. The laterally-extending end is typically oriented approximately 90° relative to the bolt's shank.

One part of the holder is a base member or base that is mountable to the forming surface that normally underlies the concrete slab. The other part is a hollow, elongated plastic sleeve member or sleeve that has a split-apart side. A certain length of the anchor bolt's shank is received within such sleeve, and the bolt extends axially outwardly through the sleeve's upper end. The bolt's other end extends laterally outwardly through the sleeve's split-apart side, and is gripped thereby. The lower end of the sleeve is shaped for male/female fitment into an upwardly opening socket in the base, for connecting the two parts together.

The sleeve's split-apart side or "split" is defined by a pair of laterally spaced-apart side edges that extend along most of the sleeve's length. These have two functions. First, they have opposing recessed surfaces, or notches, that function to grip and hold the bolt's laterally-extending end, thereby providing a way to adjust the bolt's vertical position or height. Second, they create at least one large opening through the sleeve's sidewall, along the bolt's shank, that permits wet concrete to contact most or all of the shank inside the sleeve. The sleeve may also have other openings through its sidewall, spaced apart from the split-apart side edges just described, for facilitating the shank-to-cement contact area.

In use, a plurality of bases in accordance with the invention are mounted across the forming surface at certain preselected positions. Typically, this is followed by other pre-pour preparations previously described (placement of electrical conduit, plumbing, etc.), followed by placement of a sleeve with anchor bolt in each base. The bolt is adjusted in each sleeve by means of the above-described notches, so that after the sleeve has been inserted in its respective base, the bolt's threads will be positioned at a certain height over the forming surface, adequate to protrude above the top surface of the slab after it has been poured.

Referring now to the accompanying drawings, and the following description, the invention will now be described in greater detail, addressing the features summarized above, and certain other features as well.

BRIEF DESCRIPTION OF THE DRAWINGS

In the drawings, like reference numerals and letters indicate like parts throughout the various views, and wherein:

FIG. 3 is a cross-sectional view taken along line A—A in FIG. 1;

FIG. 4 is an exploded pictorial view showing how the anchor bolt holder of FIGS. 1 and 2 is placed on a forming surface that underlies a concrete slab to be poured;

FIG. 5 is a cross-sectional view taken along line B—B in FIG. 2;

FIG. 6 is a cross-sectional view taken along line C—C in FIG. 2;

BEST MODE FOR CARRYING OUT THE INVENTION

Figure 1:
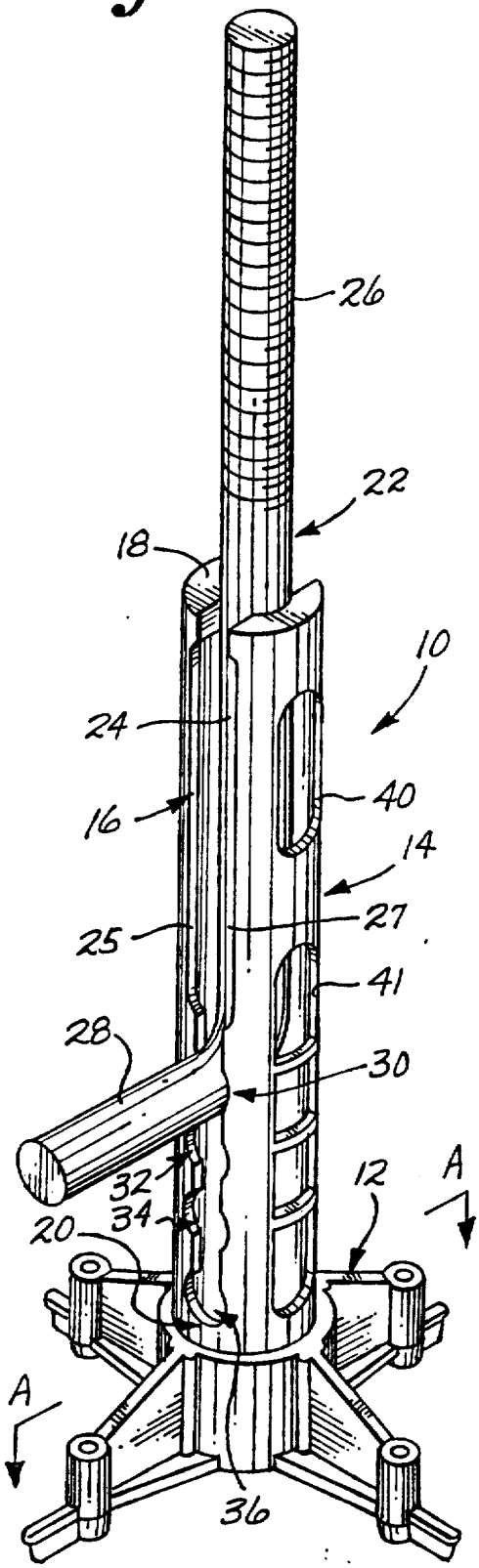
FIG. 1 is a pictorial view of an anchor bolt holder in accordance with a preferred embodiment of the invention.

Referring now to the drawings, and first to FIG. 1, therein is shown generally at 10 an anchor bolt holder constructed in accordance with a preferred embodiment of the invention. As mentioned above, the holder 10 is a two-part system consisting of a base member or base 12, and a sleeve member or sleeve 14. The sleeve 14 is hollow, and preferably made of plastic. It has a split or split-apart side 16 extending downwardly from its upper end 18 to near its lower end, the latter position being indicated generally by arrow 20 in FIGS. 1 and 7.

Received within the sleeve 14 is an anchor bolt 22 of conventional design. Briefly, the anchor bolt 22 includes an elongated shaft 24 having a threaded end 26, and an opposite end 28 that extends laterally outwardly through the sleeve's split-apart side 16. As is apparent from the drawings, a certain length of the bolt's shank 24 is received inside the sleeve 14. As is also apparent, the lateral side edges 25, 27 defining the width of split 16 serve to grip and thus hold the bolt 22.

With respect to the latter, a lower portion of the sleeve's split 16 is shaped to define a plurality of notches 30, 32, 34, 36 which provide vertical adjustment of the position or height of the anchor bolt 22. Each notch 30 32, 34, 36 is created by a pair of curved recesses 38, 39, arranged across from each other in lateral edges 25, 27, with one recess facing the other (see FIG. 7), The bolt's vertical position may be adjusted by simply sliding it upwardly or downwardly, in and out of any one of the plurality of positions defined by notches 30, 32, 34, 36. The recesses 38, 39 defining each notch cooperate to surround at least a portion of the bolt's end 28 when it is positioned between the recesses. The plastic material making up the sleeve 14 is sufficiently flexible to allow the splitapart side 16 to elastically expand slightly when the bolt's end 28 is pulled out of one notch and moved into another.

In preferred form, the split's lateral edges 25, 27 are spaced sufficiently far apart to create a wide opening through the sleeve's sidewall. The space inbetween permits wet concrete to contact the bolt's shank 24, thus setting it in the concrete when the holder 10 is placed into use. In order to ensure that sufficient concrete-to-bolt contact is made on all sides of the bolt, the sleeve 14 also has a plurality of other, spaced-apart openings 40, 41, 42, 44 distributed around the sleeve.

Referring now to FIG. 4, the anchor bolt holder 10 is typically placed in use by first attaching one or more bases 12 to a forming surface 46 (plywood decking, for example) that underlies the slab to be poured. As a person skilled in the art would know, the bases 12 would be arranged in a certain preselected pattern corresponding to the need for anchor bolts in such positions. After the other pre-pour preparations are made, a sleeve 14, with an anchor bolt 22 held inside, is inserted in each base 12.

In order to accomplish this, each base 12 has an upwardlyopening socket 48 that receives, in male/female fitment, the lower end 50 of the sleeve 14. Preferably, the sleeve's end 50 and base socket 48 are shaped so that such fit is fairly tight, in order to prevent the sleeve 14 from lifting away from the base 12 as the level of concrete rises during the pour. Of course, and as should be clear by now, the anchor bolt 22 is properly positioned in the sleeve 14 via one of notches 30, 32, 34, 36 so that its vertical height will be correct relative to the slab.

Figure 7:
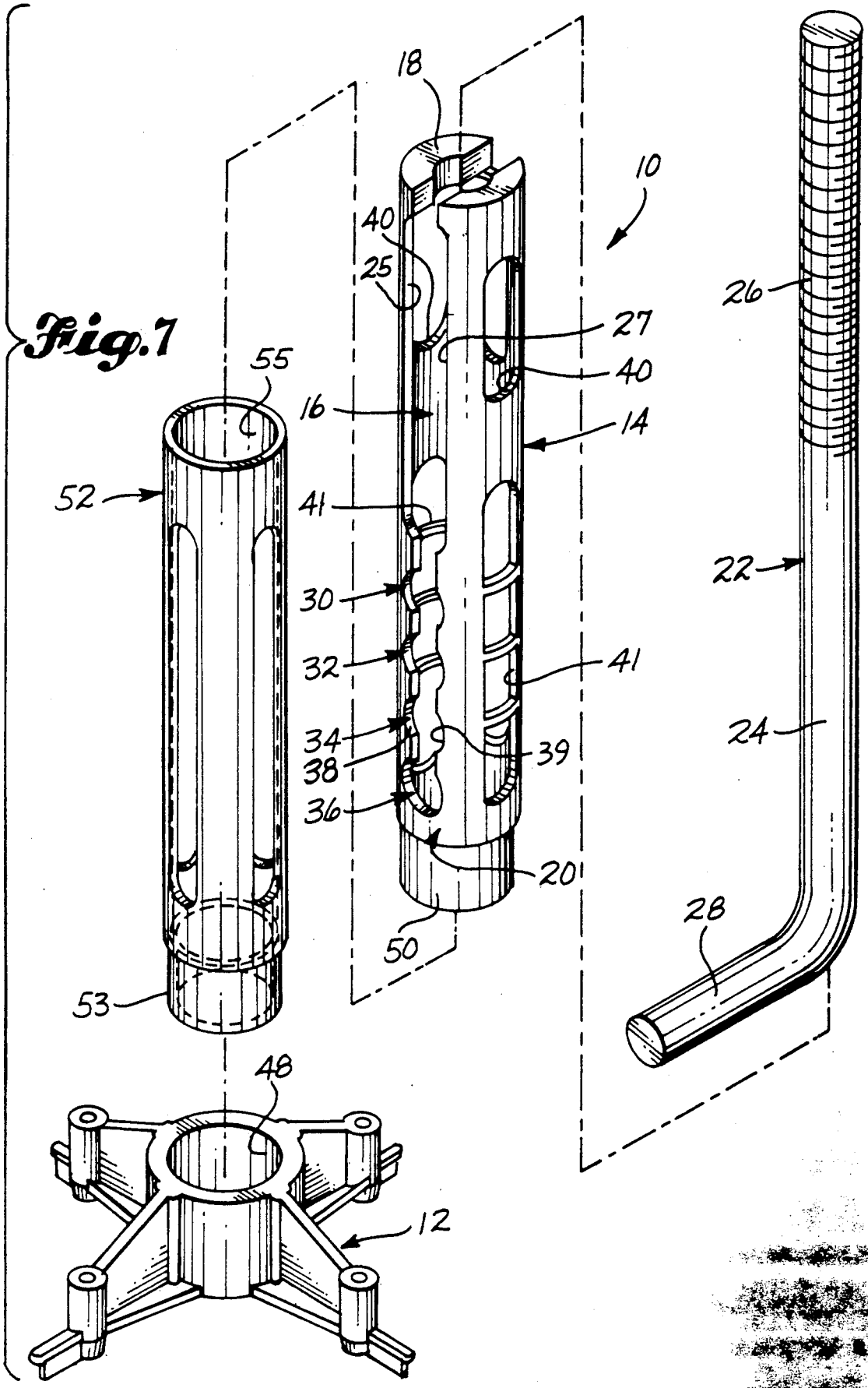
FIG. 7 is another exploded pictorial view of the anchor bolt holder, but shows an extension sleeve member for connecting the holder's sleeve to its base in certain situations.

An alternative embodiment of the invention is shown in FIG. 7. There, an extension sleeve member 52 is provided for interconnecting the sleeve 14 to the base 12. Extension sleeve 52 is used in certain situations where the depth of the slab to be poured requires sleeve 14, and anchor bolt 22 held thereby, to be placed at a higher position than normal. Like sleeve 14, extension sleeve 52 has a lower end 53 shaped for male/female fitment into the base's socket 48. Its upper end 55 defines an upwardly opening socket 55 that functions like the base's socket 48, for receiving the sleeve's lower end 50.

Figure 9:
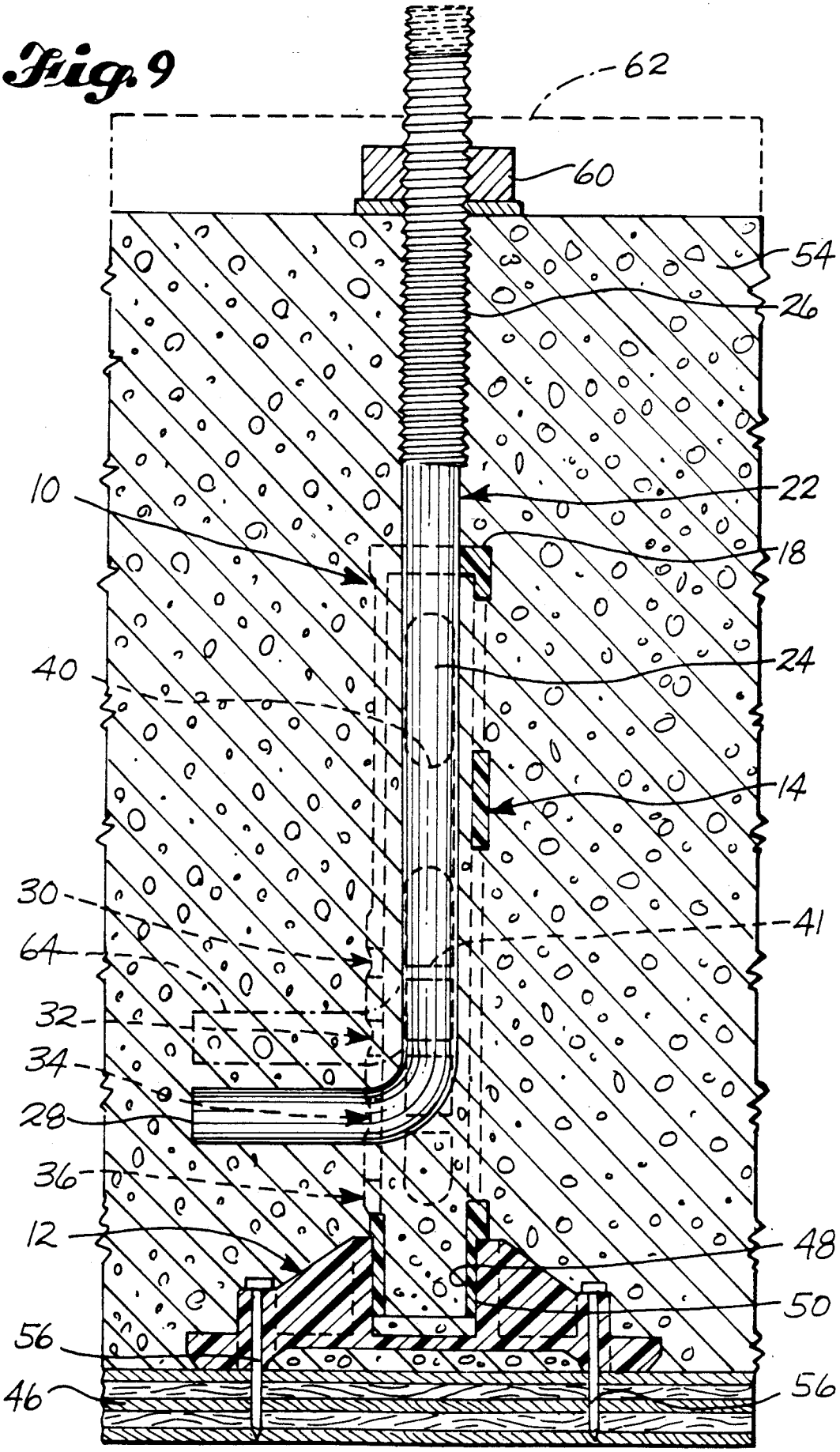
FIG. 9 is a view like FIG. 8, but illustrates the adjustability of the anchor bolt holder.
Figure 8:
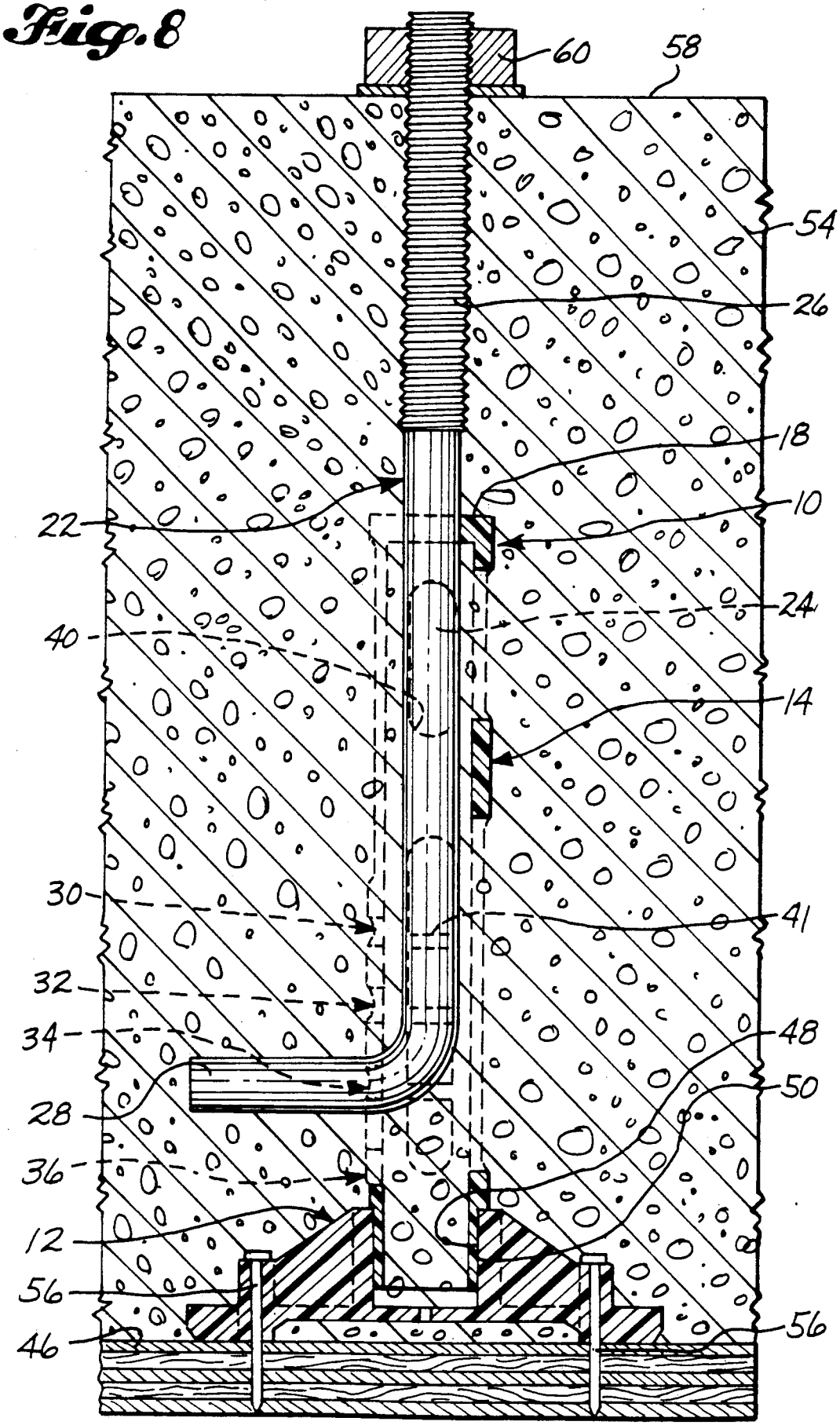
FIG. 8 is a side cross-sectional view of the anchor bolt holder installed in a poured slab of concrete.
Figure 9:
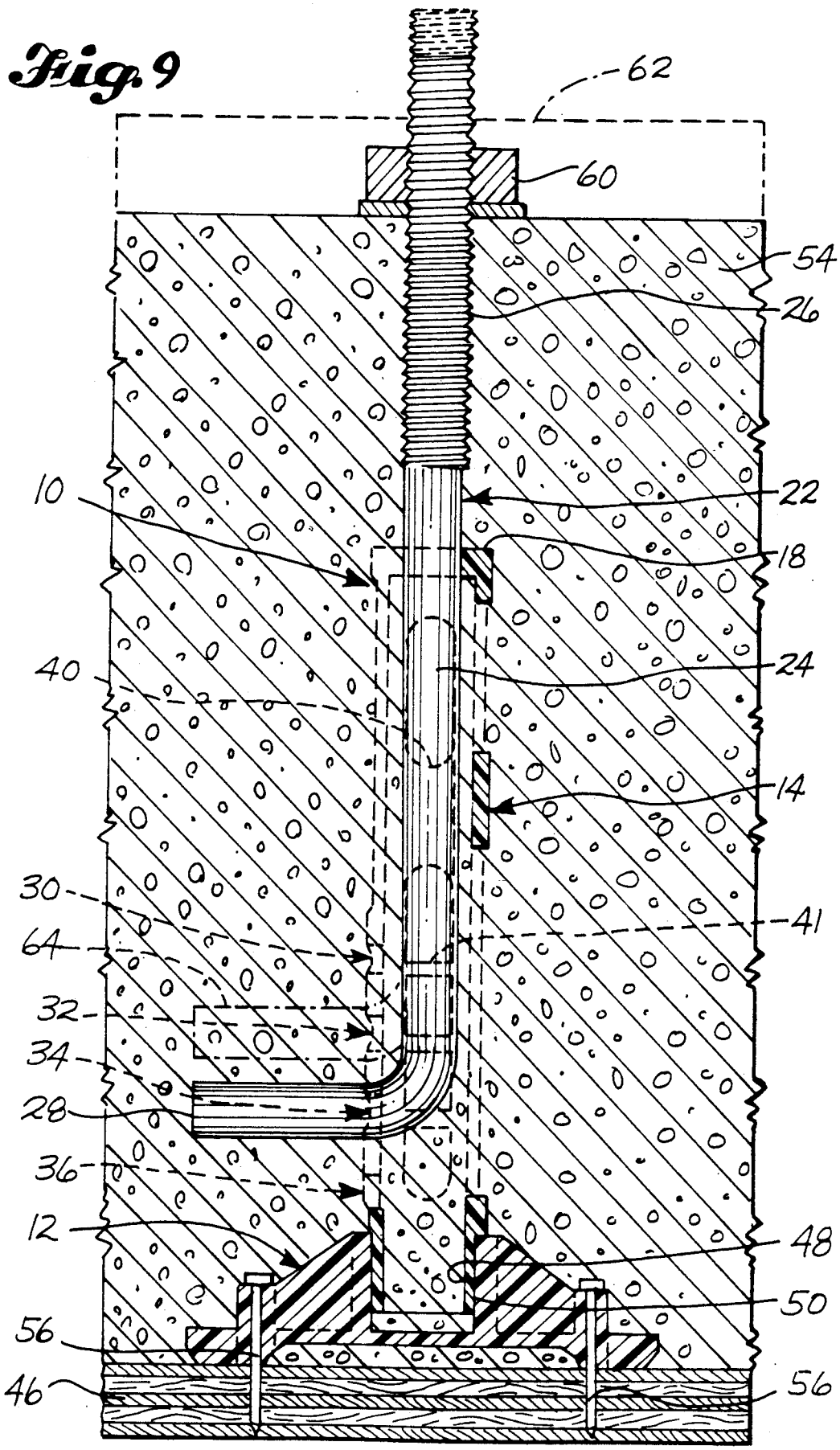

FIGS. 8 and 9 illustrate how the anchor bolt holder 10 sets a typical anchor bolt 22 in a slab of concrete 54. The base plate 12 is shown mounted to forming surface 46 by nails 56, although other modes of attachment such as staples or glue could be used just as easily. As mentioned previously, the height of the anchor bolt 22 is selected via notches 30, 32, 34, 36 so that its threaded end 26 protrudes a certain distance above the slab's top surface 58 after it has been poured and leveled. A conventional nut 60 is threaded onto such end for attaching other structures to the concrete 54.

In situations where the slab's depth may vary from one pour to another, it is easy to adjust the anchor bolt's height by moving it upwardly (or downwardly, as the case may be) along notches 30, 32, 34, 36. This is schematically indicated in FIG. 9, Where dashed line 62 indicates a new height for slab 54, and dashed line 64 indicates the elevated position of anchor bolt 22. Of course, in most cases, the position of bolt 22 is adjusted prior to the pouring of the slab 54.

Having thus described a preferred embodiment of the invention, it is to be understood that the anchor bolt holder 10 disclosed herein could be changed in many ways without departing from the overall spirit and scope of what is intended to be the invention. For example, the preceding description is directed to "J" or "L"-shaped anchor bolts where the bolt's laterally-extending end 28 is gripped by a split 16 in sleeve 14. Use of the invention is certainly connected to these specific bolts, at least so far as the invention is presently understood. One important aspect of the invention is the easy adjustability in bolt height that is provided by sleeve 14. However, another important aspect is the way the sleeve 14 is provided with openings, to ensure good concrete-to-bolt contact, so that the bolt will be set in the concrete with adequate pull strength. Thus, it is conceivable that an equivalent sleeve may be used in certain situations for adjustably holding other kinds of anchor bolts not described above.

It is intended, therefore, that the preceding description not be construed as limiting applicant s patent coverage. Instead, such coverage is to be limited by the subjoined patent claim or claims which follow, with the scope thereof being determined in accordance with the well-established doctrines of patent claim interpretation.

What is claimed is:

1. An anchor bolt holder for use in setting an anchor bolt in a concrete slab and the like, the anchor bolt having an elongated shank with a threaded end, and an opposite end extending laterally relative to said shank, said anchor bolt holder comprising:

a base member, mountable to a forming surface that underlies said concrete slab during pouring of the same; and a hollow, cylindrically-shaped sleeve member, said sleeve member being connectable to said base member in a manner so that said sleeve member is in a generally vertically upstanding position relative to said base member, and further, said sleeve member receiving at least a portion of said anchor bolt's elongated shank, said sleeve member having an elongated vertical split extending along at least one side thereof, said split being defined by a pair of spaced-apart lateral side edges, said edges being adapted to grip therebetween said anchor bolt's laterally-extending end, for holding said bolt in a certain position above said forming surface.

2. The anchor bolt holder of claim 1, including a plurality of openings through said sleeve member, for permitting wet concrete to contact said portion of said anchor bolt's shank received in said sleeve member.

3. The anchor bolt holder of claim 1, wherein said lateral side edges of said split are adapted to grip said anchor bolt's laterally-extending end at any one of a plurality of positions along said split, to provide adjustable vertical positioning of said bolt over said forming surface.

4. The anchor bolt holder of claim 3, wherein said plurality of positions along said split include a plurality of notches distributed along a portion of said split, each notch comprising:

a pair of curved recesses, with each recess being in a separate one of said lateral side edges, in a manner so that one recess faces the other, said recesses cooperatively surround at least a portion of said anchor bolt's laterally-extending end, when said end is positioned between said recesses, each notch widening the distance between said lateral side edges relative to the distance between said edges at certain positions that are inbetween said notches, said inbetween positions defining a split width that is less than the diameter of said anchor bolt's laterally-extending end, and wherein said sleeve member is made of a material that is sufficiently flexible to permit resilient spreading apart of said inbetween positions as said bolt's laterally-extending end is moved from one of said notches to another notch, for adjusting the vertical height of said anchor bolt.

5. The anchor bolt holder of claim 1, wherein said base member includes an upwardly opening socket, and wherein a lower end of said sleeve member is shaped for releasable male/female fitment into said socket, for connecting said sleeve member to said base member in said generally vertically upstanding position, said sleeve member normally being connected to said base member after said base member has been mounted to said forming surface.

6. The anchor bolt holder of claim 5, including an extension member, for connecting said sleeve member to said base member, said extension member having a lower end shaped for male/female fitment into said base member's upwardly opening socket, and further having an upper end that defines an upwardly-opening socket sized for receiving, in male/female fitment, said lower end of said sleeve member.

7. A two-part anchor bolt holder for use in setting an anchor bolt in a concrete slab and the like the anchor bolt having an elongated shank with a threaded end, and an opposite end extending laterally relative to said shank, said anchor bolt holder comprising:

a base member, mountable to a forming surface that underlies said concrete slab during pouring of the same, said base member having an upwardly opening socket; and a hollow sleeve member having an upper end and a lower end, said sleeve member being splint apart along one side thereof from its upper end to near its lower end, and wherein at least a portion of said anchor bolt's elongated shank is received within said sleeve member and extends upwardly through said upper end of said sleeve member, and said anchor bolt's laterally-extending end projects through said split-apart side of said sleeve member, the lateral edges thereof gripping said laterally-extending end, for holding said anchor bolt in a certain position above said forming surface, and said sleeve member's lower end being shaped for male/female fitment into said upwardly opening socket of said base member in a manner so as to releasably connect said sleeve member to said base member, and to hold said anchor bolt in a generally vertical position when said sleeve member is connected to said base member, said sleeve member normally being connected to said base member after said base member has been mounted to said forming surface.

8. The anchor bolt holder of claim 7, including a plurality of notches distributed along a portion of said split-apart side of said sleeve member, each notch comprising:

a pair of curved recesses, with each recess being in one separate lateral side edge of said sleeve member's split-apart side, in a manner so that the recess in one lateral side edge faces the recess in the other lateral side edge, said pair of recesses cooperatively surrounding at least a portion of said anchor bolt's laterally-extending end, when such end is positioned between said recesses, each notch widening the distance between said lateral side edges relative to the distance between said edges at certain positions that are inbetween said notches, said inbetween positions defining a width of said split-apart side that is less than the diameter of said anchor bolt's laterally-extending end, and wherein said sleeve is made of a material that is sufficiently flexible to permit resilient spreading apart of said inbetween positions as said bolt's laterally-extending end is moved from one of said notches to another, for adjusting the vertical height of said anchor bolt.

9. The anchor bolt holder of claim 7, including a plurality of openings through said sleeve member, said openings being spaced apart from each other, and spaced apart from said split-apart side of said sleeve member, for permitting wet concrete to contact said portion of said anchor bolt's shank received in said sleeve member, so that said anchor bolt will be substantially embedded in said concrete.

10. The anchor bolt holder of claim 7, including an extension member, for connecting said sleeve member to said base member, said extension member having a lower end shaped for male/female fitment into said base member's upwardly opening socket, and further having an upper end that includes an upwardly-opening socket sized for receiving, in male/female fitment, said lower end of said sleeve member.

11. A two-part anchor bolt holding apparatus, for setting an anchor bolt having an elongated shank in a concrete slab and the like, comprising:

a base member, mountable to a forming surface that underlies said concrete slab during pouring of the same; and a hollow sleeve member, releasably connectable to said base member in a manner so that said sleeve member is in a generally vertically upstanding position relative to said base member, said sleeve member normally being connected to said base member after said base member has been mounted to said forming surface, and further, said sleeve member being adapted to receive therein at least a portion of said anchor bolt's elongated shank, and to support said anchor bolt in a generally vertically aligned position above said forming surface when said sleeve member is connected to said base member, in a manner so that an upper threaded end portion of said bolt projects upwardly above said concrete slab after it is poured and has set, said sleeve member having at least one opening along its sidewall, said at least one opening being sufficiently large to permit, during pouring of said concrete slab, wet concrete to contact said shank portion received in said sleeve member.

12. The anchor bolt holder of claim 11, wherein said at least one opening along said sleeve member's sidewall includes a split-apart side of said sleeve member extending from an upper end to near a lower end of said sleeve member, and further including a plurality of openings spaced apart from each other, and from said split-apart side of said sleeve member.

13. The anchor bolt holder of claim 11, wherein said at least one opening along said sidewall of said sleeve member is defined by a split-apart side of said sleeve member, and wherein said sleeve member is split apart from an upper end to near a lower end of said sleeve member, said anchor bolt having an end that extends laterally between the lateral edges defined by said sleeve member's split-apart side, said lateral edges gripping said laterally-extending end of said anchor bolt.

14. The anchor bolt holder of claim 13, including a plurality of notches distributed along a portion of said split-apart side of said sleeve member, each notch comprising:

a pair of curved recesses, each recess being positioned in one separate lateral side edge of said split-apart side, in a manner so that the recess in one lateral side edge faces the recess in the other lateral side edge, said recesses cooperatively surrounding at least a portion of said anchor bolt's laterally-extending end, when such end is positioned between said recesses, each notch widening the distance between said lateral side edges relative to the distance between said edges at certain positions that are inbetween said notches, said inbetween positions defining a width of said split-apart side that is less than the diameter of said anchor bolt's laterally-extending end, and wherein said sleeve is made of a material that is sufficiently flexible to permit resilient spreading apart of said inbetween positions as said bolt's laterally-extending end is moved from one of said notches to another notch, for adjusting the vertical height of said anchor bolt.

15. The anchor bolt holder of claim 11, wherein said base member includes an upwardly-opening socket, and wherein a lower end of said sleeve member is shaped for male/female fitment into said socket, for connecting said sleeve member to said base member in said generally vertically upstanding position.

16. The anchor bolt holder of claim 15, including an extension member, for connecting said sleeve member to said base member, said extension member having a lower end shaped for male/female fitment into said base member's upwardly-opening socket, and further having an upper end that includes an upwardly-opening socket sized for receiving, in male/female fitment, said lower end of said sleeve member.

17. A two-part anchor bolt holding for setting and embedding an anchor bolt having an elongated shank in a concrete slab and the like, comprising:

a base member, mountable to a forming surface that underlies said concrete slab during pouring of the same; and a bolt-supporting member, releasably connectable to said base member in a manner so that said bolt-supporting member is in a generally vertically upstanding position relative to said base member, and further, said bolt-supporting member being adapted to hold said anchor bolt in a certain generally vertically aligned position above said forming surface when said bolt-supporting member is connected to said base member, and adapted to set the vertical height of said anchor bolt relative to the dept of said slab, in a manner so that an upper threaded end portion of said bolt projects above said slab after pouring and setting of the same, said bolt-supporting member normally being connected to said base member after said base member has been mounted to said forming surface.

* * * * *

UNITED STATES PATENT AND TRADEMARK OFFICE

CERTIFICATE OF CORRECTION

PATENT NO. : 5,050,364

DATED : September 24, 1991

INVENTOR(S) : Michael S. Johnson and James I. Mothersbaugh

It is certified that error appears in the above-identified patent and that said Letters Patent is hereby corrected as shown below:

In the Abstract, the sixth line from the bottom, after "wet concrete", insert --to contact--.

Signed and Sealed this

Eighteenth Day of February, 1992

*Attest:*

*Attesting Officer*

HARRY F. MANBECK, JR.

*Commissioner of Patents and Trademarks*

UNITED STATES PATENT AND TRADEMARK OFFICE

CERTIFICATE OF CORRECTION

PATENT NO. : 5,050,364

DATED : September 24, 1991

INVENTOR(S) : Michael S. Johnson and James I. Mothersbaugh

Figure 2:
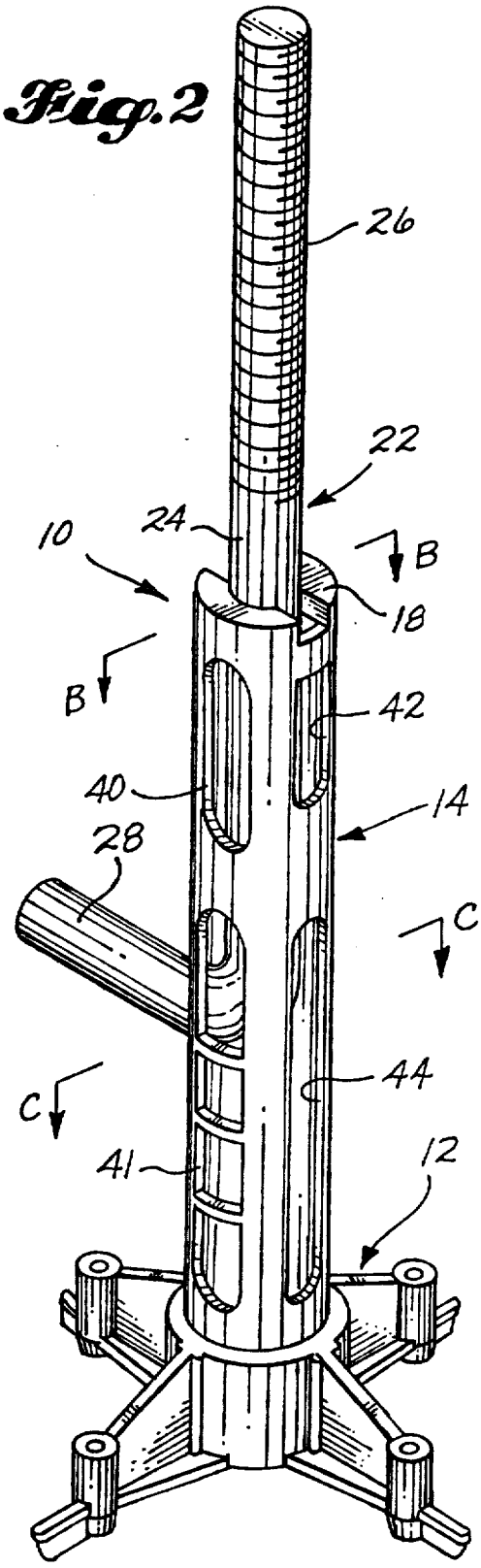
FIG. 2 is another pictorial view of the anchor bolt holder shown in FIG. 1, but with the holder rotated approximately 90° from its position as shown in FIG. 1.

It is certified that error appears in the above-identified patent and that said Letters Patent is hereby corrected as shown below:

The sheet of drawing numbered 1 of 5 consisting of figure 9 should be deleted to appear as per attached sheet 1 of 5 consisting of figures 1 and 2.

Column 1, line 38, there is a period after "supports".

Column 1, line 54, there is a period after "obselete".

Column 2, line 9, there is a period after "items".

Column 2, line 68, there is a period after "implement".

Column 4, line 51, "splitapart" should be -- split-apart --.

Column 5, lines 5 and 6, "up-wardlyopening" should be -- upwardly-opening --.

Column 5, line 42, "Where" should be -- where --.

Claim 4, col. 6, line 45, "surround" should be -- surrounding -.

Claim 7, column 7, line 10, there is comma after "like".

Claim 7, column 7, line 19, "splint" should be -- split --.

Claim 17, column 10, line 1, "holding" should be -- holder --.

Claim 17, column 10, line 17, "debt" should be -- depth --.

1/5